US005481986A

United States Patent [19]

Spencer et al.

[11] Patent Number: 5,481,986

[45] Date of Patent: Jan. 9, 1996

[54] LIGHTWEIGHT TRUCK SIDEFRAME

[75] Inventors: Charles P. Spencer, Staunton, Ill.; Franklin S. McKeown, St. Louis; Donald J. Lane, Imperial, both of Mo.

[73] Assignee: AMSTED Industries Incoporated, Chicago, Ill.

[21] Appl. No.: 336,763

[22] Filed: Nov. 9, 1994

[51] Int. Cl.[6] ..... B61F 5/52

[52] U.S. Cl. ..... 105/206.1

[58] Field of Search ..... 105/206.1, 206.2, 105/208

[56] References Cited

U.S. PATENT DOCUMENTS

| | | | |
|---|---|---|---|
| 2,235,799 | 3/1941 | Cottrell | 105/206.1 |
| 2,406,862 | 9/1946 | Stertzbach | 105/206.1 |
| 2,443,980 | 6/1948 | Fish | 105/206.1 |
| 4,254,712 | 3/1981 | O'Neil | 105/198.5 |
| 4,424,750 | 1/1984 | Tilly et al. | 105/206.1 |
| 5,305,694 | 4/1994 | Wronkiewicz et al. | 105/206.1 |
| 5,410,968 | 5/1995 | Hawthorne et al. | 105/206.1 |

*Primary Examiner*—Robert J. Oberleitner

*Assistant Examiner*—S. Joseph Morano

*Attorney, Agent, or Firm*—Edward J. Brosius; F. S. Gregorczyk

[57] ABSTRACT

A lightweight, cast steel railcar truck sideframe is the result of matching stress levels within each of the sideframe components with an amount of metallic mass necessary to maintain structural integrity during railcar loading. Areas on each component which were found to be low stress accumulation areas have removed mass from them, reducing sideframe weight. The removal of mass is accomplished by adding lightener holes to and/or reducing thickness of the particular component. Areas on each component found to be high stress areas have added mass in order to strengthen the sideframe. Areas with reduced mass far exceed those increased. The lightener holes are uniquely used in the casting mold such that only nine cores are needed when casting the entire sideframe. By using only a total of nine cores instead of twenty-eight, substantial manhour and production costs savings are realized. The nine core mold also improves internal and external casting quality through the stabilization of core geometry, elimination of seam lines and stress riser locations, which means that there will be far less of a chance for defects to occur.

7 Claims, 6 Drawing Sheets

LIGHTWEIGHT TRUCK SIDEFRAME

FIELD OF THE INVENTION

This invention relates to an improved railcar truck and more particularly to a lighter weight three-piece truck. These types of trucks are well known in the railroad industry and the term "three-piece" refers to a truck which consists of two sideframes that are positioned parallel to the wheels and rails, and to a bolster that transverses between each of the sideframes. Railcar trucks operate in a severe operating environment where they must be strong enough to support both the car structure and its contents, particularly the sideframes on which the car body is either directly or indirectly supported. Most usually this means that the sideframes and bolsters will be manufactured from cast steel, making the sideframe a large contributor to the total weight placed upon the rails. Thus, the maximum quantity of product a shipper may place within a railcar will be directly affected by the weight of the car body, the trucks, and its contents. Any weight reduction that is made to the truck will be directly available as increased carrying capacity of the car. But weight reduction in the sideframe castings has heretofore been approached very conservatively in order to eliminate field failures. Recent developments in improved laboratory simulation testing and computer analysis techniques, combined with the increased experience in sideframe manufacturing testing, has now made it possible to design and produce lighter weight sideframes without sacrificing operational safety and performance. Greater use of improved testing techniques and advanced computer analysis has led sideframe designers to reexamine existing sideframe designs in order to determine if there are areas of "dead weight" which can be eliminated. Moreover, these techniques have also helped to more precisely identify the primary loadcarrying areas on the existing models of sideframes and more readily identify whether these areas should be structurally enhanced.

SUMMARY OF THE INVENTION

Accordingly, it is the primary object of the present invention to more precisely identify the areas of the sideframe which contain non-critical load-bearing areas and to reduce the weight of the railcar truck sideframe by removing metallic mass from those noncritical areas.

It is another object of the present invention to more precisely identify the areas of the sideframe which are considered critical load-bearing areas and to structurally reinforce those areas with additional metallic mass, as necessary.

It is a final object of the present invention to improve the casting quality of the sideframe by simplifying the internal core assembly of the casting mold, made possible by the removal of metallic mass from non-critical areas and the redistribution of mass to critical areas.

Briefly stated, the present invention primarily involves the reduction of metal in the following sideframe components: 1) the top compression member; 2) the sideframe columns behind the wear plate area; 3) the outer pedestal jaw member wall; 4) the upper surface of the diagonal tension member; 5) the bottom half of sideframe of the column member; 6) the top surface of the spring seat plate. Removing metallic mass in the above-mentioned areas substantially involves adding additional lightener holes to the sideframe as indicated. In addition to removing the unnecessary dead weight, the extra lightener holes will actually affect and improve the quality of the casting by stabilizing the internal casting mold cores, since only one core is required to cast the entire sideframe end of the present invention. Casting an entire sideframe end from only one core is made possible because the casting mold is partially supported by the above-mentioned lightener holes. Providing one core to cast the sideframe midsection, and a respective core, with the appropriate appendages, to cast each sideframe end, is a significant departure from the current casting practices which typically require multiple cores within each sideframe end and midsection. The reduced-core sideframe of the present invention offers several distinct advantages over the current multiple-core casting. A primary advantage of using only one core per section (3 cores total per sideframe), is that dimensional consistency is markedly improved, permitting reductions in the cross-sectional thickness of several areas on the sideframe, and doing so without the possibility of the cross-sectional thicknesses becoming too thin, as might occur with present casting techniques. By this, it is meant that with present casting techniques using multiple cores, chaplets are used to hold each core within the mold at a determined, spaced distance from the adjacent core, thereby setting the relevant cross-sectional thickness of the casting. However, during handling of the mold, it is not unusual for the chaplets to shift somewhat, resulting with some of the sideframe cross-sectional thicknesses being cast with either thicker or thinner dimensional tolerances than desired. Due to the ever-present possibility of chaplets and cores shifting, certain sideframe structural areas are intentionally cast with thicker-than-necessary cross-sectional thicknesses in anticipation of a core shifting and leaving a particular member too thin. If a core does not shift, the sideframe cross-sectional thickness will be produced with a thicker-than-necessary dimensions. It follows then that the sideframe will be carrying extra metallic mass, thereby adding to the total weight of the truck. Thus, it can be appreciated that casting a sideframe with either a heavier sideframe than needed or with a sideframe having multiple cores results with inconsistent cross-sectional geometries. Furthermore, the inconsistencies provide stress accumulation areas between non-uniform cross-sectional areas.

It should also be appreciated that fewer cores and fewer chaplets automatically enhances dimensional consistency and stabilizes the structural geometry of the sideframe such that the sideframe cross-sectional thicknesses can be reduced, resulting with a lighter and structurally stronger truck member.

Another major advantage of the present invention is that it substantially stabilizes the mold during handling, thereby eliminating much of the possibility for sand particles to loosen during handling or core shifting and becoming inclusions in the cast metal. Still another advantage is that it eliminates the seam lines which normally form between cores due to the inconsistent cross sections. Eliminating the seam lines will significantly reduce the finishing requirements of the casting and greatly improve the finished appearance. But more importantly, eliminating the seam lines will eliminate the potential for stress risers to occur, because seam lines represent areas where stress accumulations can occur. Moreover, the reducted-core casting mold is considerably cheaper to produce than the current multiple core casting mold because it requires substantially less equipment and manpower to make fewer cores.

BRIEF DESCRIPTIONS OF THE DRAWINGS

Other objects and advantages of the present invention will become apparent from the following detailed descriptions taken in conjunction with the drawings wherein.

DETAILED DESCRIPTION OF THE INVENTION

Figure 1:
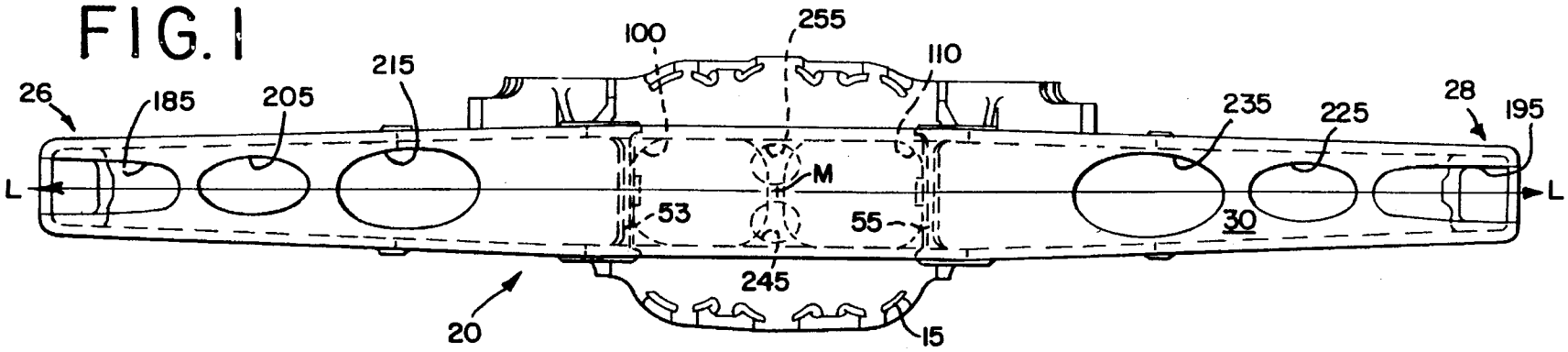
FIG. 1 is a top plan view of a railcar truck sideframe according to the present invention.
Figure 2:
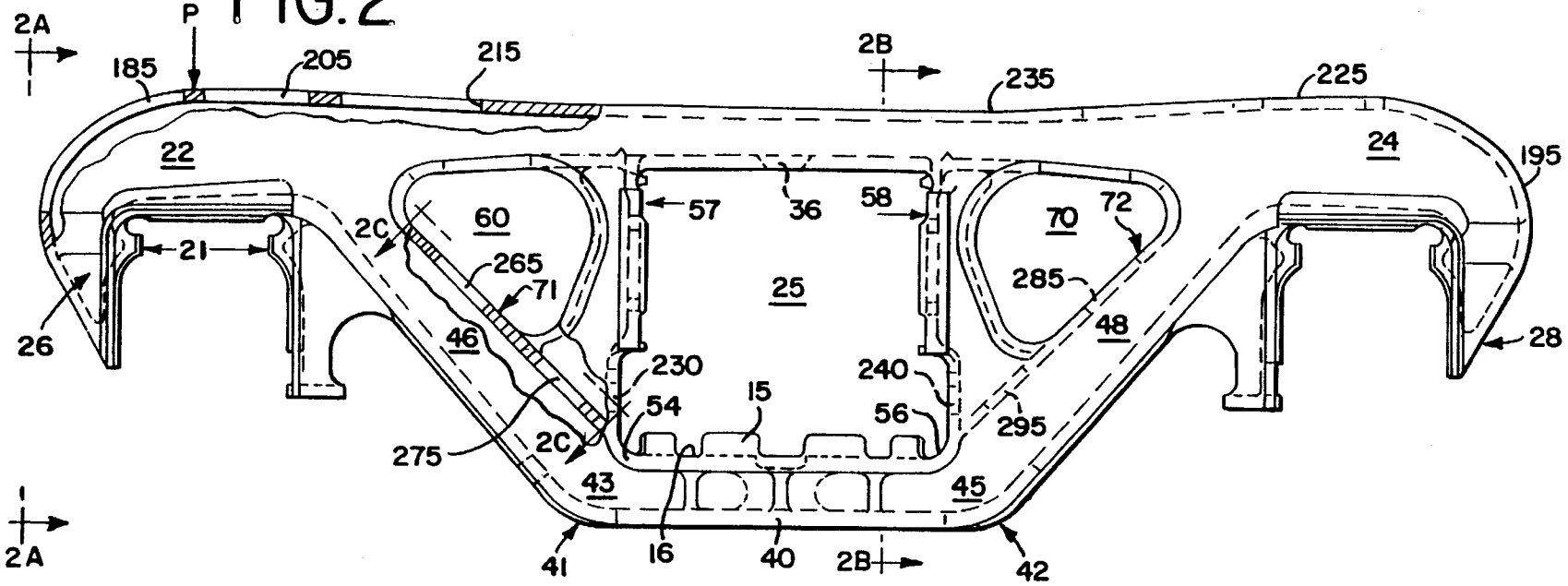
FIG. 2 is a side elevation view of the sideframe as shown in FIG. 1.
Figure 3:
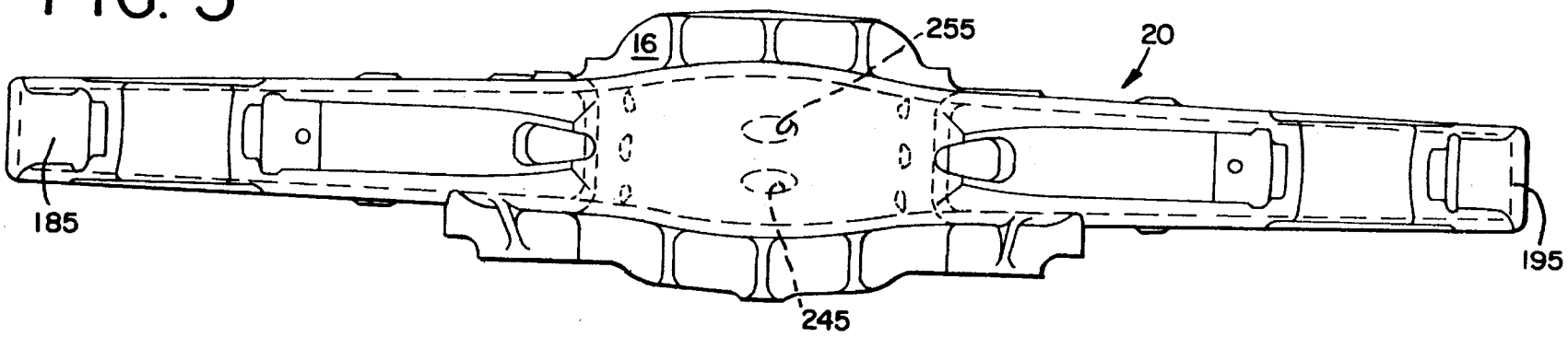
FIG. 3 is a bottom plan view of the sideframe as shown in FIG. 1.

FIGS. 1–3 illustrate the preferred embodiment of a cast steel railcar truck sideframe according to the present invention wherein the sideframe 20 has a longitudinal axis "L" and will generally include an upper or top compression member 30 extending lengthwise of the truck, and a lower tension member 40, generally parallel to upper member 30. Lower member 40 also has upwardly extending diagonal arms 46,48, connecting the upper and lower members together. Vertical column members 53,55 also connect the upper and lower members together, while forming the structural framework necessary for defining bolster opening 25. Each sideframe end, designated at 22 and 24, has a downwardly depending jaw portion 26,28, for retaining the truck axle bearing within the bearing retainer thrust lugs 21 on each jaw. Upwardly extending diagonal arms 46,48 respectively depend from a first end 41 and a second end 42 of lower member 40 such that the respective connection points form respective first and second bend points, 43,45. The base of each vertical column is herein designated as 54,56, and each base is tied into bottom member 40 at the respective bend points 43,45, while a top portion of each column is tied into the bottom wall 32 of upper compression member 30. As previously mentioned, a truck bolster (not shown) will be mounted transversely between the sideframes to form the three-piece truck that is located beneath one end of a railcar body. The bolster ends extend through windows 25 in each respective sideframe 20, and are supported by spring groups (not shown) that rest on a horizontally disposed spring base plate 16 which extends between columns 53,55 and is integrally formed as part of lower tension member 40. The spring group is held in place by a plurality of spring seat bosses 15 integrally cast as part of base plate 16, and the base plate is of a substantial cross-sectional thickness in order to resist the bending moments acting on the plate when the springs are compressed during vertical loading. A pair of damping devices (not shown) are retained on opposite sides of each end of bolster for frictionally engaging a wear plate area 57,58 on each vertical column 53,55 of each sideframe in order to harmonically dampen the energy stored within the springs.

Figure 2B:
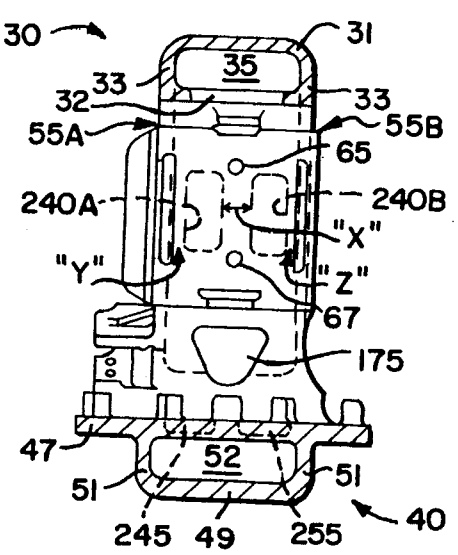
FIG. 2B is a cross-sectional side view taken along line 2B—2B of FIG. 2.

As seen from FIG. 2B, upper member 30 is actually comprised of a top wall 31, bottom wall 32, and arcuate interconnecting sidewalls 33 which define an upper compression member core opening 35 that extends the longitudinal length of sideframe 20, except for the midsection area between the vertical columns. In that area, there is a substantial portion of the bottom wall removed for weight saving purposes, effectively leaving the bottom midsection area "open"; this will become clearer later in the discussion. Each of the upper member walls has a cross-sectional thickness that varies according to the rated truck tonnage. Similarly, bottom tension member 40 is also comprised of a top wall 47, a bottom wall 49, and arcuate interconnecting sidewalls 51 which form a lower tension member core 52. Core opening 52 extends the entire length of member 40, including within the upwardly extending diagonal arms 46,48. Although not shown, it is to be understood that each vertical column 53,55 is defined by cores which vertically extend the entire extent of each column.

Attention is now directed to FIGS. 7–10 where a prior art sideframe is shown. A comparison of that sideframe to the one of the present invention will now be provided so that a clear understanding of the structural differences is gained. The prior art sideframe is also comprised of a top compression member, a bottom tension member, and vertical columns, and like the present invention, prior art sideframes were designed to eliminate as much unneeded metallic mass as possible. Some of the same weight saving features have been retained in the sideframe of the present invention. For example, the figures show that the prior art sideframes were typically constructed with large lightener openings 60,70 in the area of the sideframe generally bounded by the upper and lower members and the column members. These openings represent the greatest amount of weight saved on a sideframe and they have been retained in the present sideframe, referenced by the same numerals.

Figure 7:
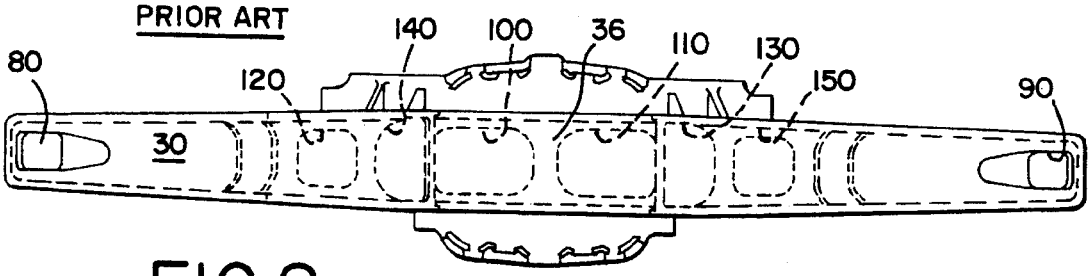
FIG. 7 PRIOR ART
FIG. 7 is a top view of a prior art sideframe.
Figure 8:
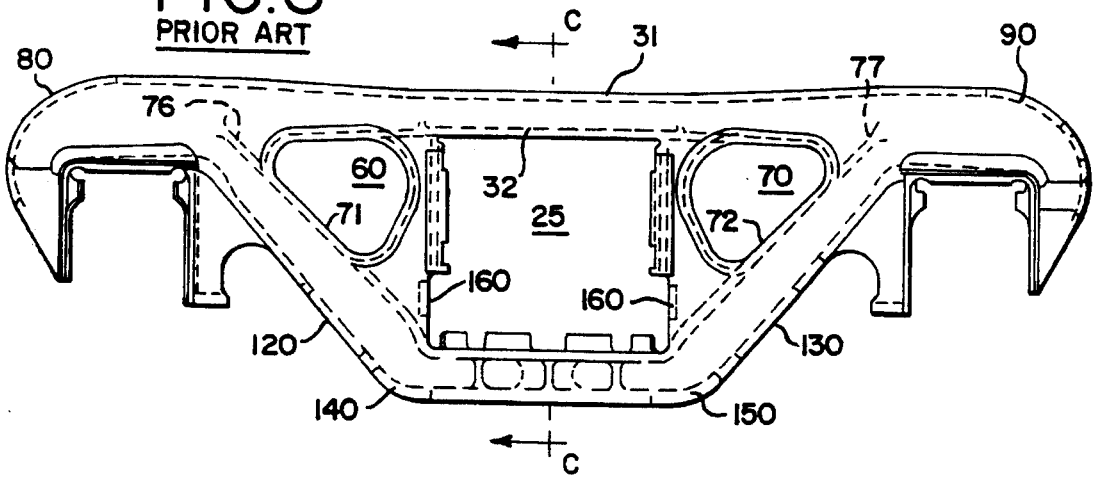
FIG. 8 PRIOR ART
FIG. 8 is an elevation view of a prior art sideframe.
Figure 9:
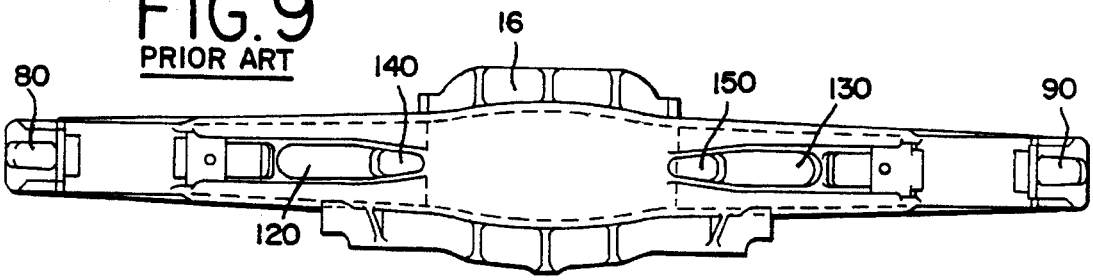
FIG. 9 PRIOR ART
FIG. 9 is a bottom view of a prior art sideframe.
Figure 10:
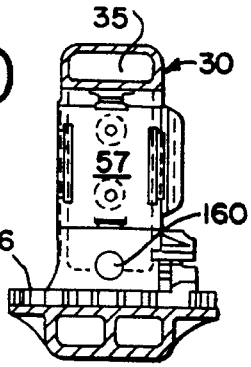
FIG. 10 PRIOR ART
FIG. 10 is a cross-sectional sideview taken along line C—C of FIG. 8.

Other less significant openings on prior art sideframes were provided on specific areas of each sideframe component. For example, FIGS. 7–9 show the upper compression member top wall 31 with lightener openings 80,90 at each pedestal jaw and the bottom wall has with the large openings 100 and 110 in the midsection. Openings 100,110 extend the width of bottom wall 32 such that brace 36 is the only remaining section of bottom wall 32 spanning the midsection area. As mentioned earlier, the midsection of the sideframe is the only area of the upper compression member which does not form an enclosed core opening 35, and this is due to openings 100 and 110. On the lower tension member, the bottom wall has been provided with lightener openings at two locations, illustrated at 120,130 and at 140,150. Openings 120 and 130 are no longer provided on the lower tension member of the present sideframe, and this structural difference will be explained in greater detail below. Openings 140,150 have been retained at the bend points 43,45 on the present invention, and they remain substantially the same dimensional size as before. The present sideframe has also retained a lightener hole at each of the jaw areas, but the holes have been substantially increased in size compared to former openings 80,90. FIG. 10 shows that each of the vertical columns on the prior art sideframe include a core support hole opening 160, which was not specifically intended for weight reducing purposes, but nevertheless, lessened the overall weight of the sideframe. These core support hole openings 160 serve to facilitate positioning of sand cores within molding flasks prior to pouring molten metal into the mold and for assisting in the subsequent removal of the mold after the cast metal cools. The present invention retains this core support hole in the same area, but present core support hole 175 is substantially larger. It should be realized that even though some of the prior art weight savings features have been retained in the present invention, the present invention involves adding additional weight saving holes in unique combinations, actually making the present sideframe lighter, yet stronger than prior art sideframes. The additional weight savings features of the present invention will now be discussed.

It has been identified that the principle area of the sideframe which handles the greatest majority of stress is in the midsection of the sideframe, namely within lower member 40 between the vertical columns 53,55, and within each diagonal arm 46,48. The present invention has investigated this area thoroughly for potential non-stress locations, knowing that the flexure and static forces acting on a sideframe are decreasing as the distance away from the center of the sideframe increases and that the forces acting at the sideframe ends are the lowest in magnitude. The newer lab techniques and the computer analysis programs were collectively used as a means to match the stress concentrations at a given area with the amount of mass in that stress location; this was not done with prior art sideframes. In short, the present invention is concerned with removing mass from areas which have been determined as being non-critical, and adding mass to areas designated as critical, or primary load carrying areas. Taking metallic mass from a non-critical area and then reposturing it to a critical area produces greater structural integrity.

Figure 2C:
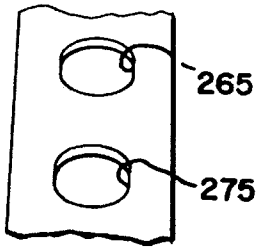
FIG. 2C is a cross-sectional top view taken along line 2C—2C of FIG. 2.
Figure 2A:
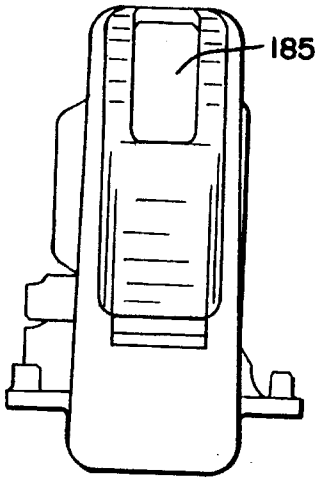
FIG. 2A is a cross-sectional side view taken along line 2A—2A of FIG. 2.

Turning attention now to the sideframe of the present invention shown in FIGS. 1–3, it was determined that the outer pedestal jaws 26,28 experienced the least critical loading stresses and in relation to the mass comprising each jaw, removal of some of that mass was in order. In that respect, if FIGS. 1–3 are comparted with FIGS. 7–10, it is seen that top wall 31 of upper compression member 30 has a much larger lightener hole at the jaw area. The hole generally starts from the bearing thrust lug level 21, and upwardly extends along the curved perimeter of the jaw to a point "P". FIGS. 2A and 3 show this enlarged area as new lightener holes 185,195, wherein the new holes are about 25% larger in cross-sectional area than a similarly located hole of a prior art sideframe.

Two additional non-critical stress areas on the top compression member top wall were identified and each area was provided with a lightener hole set 205,215 and 225,235. The hole sets are generally disposed between a respective vertical columns 53 or 55 and a respective pedestal jaw 26 or 28. Their location is critical to prevent failure under AAR (American Association of Railroads) specification static tests, which can buckle even solid members in some designs. Each set is identical in shape and dimensional size to each other, however, the holes 205,225, are smaller in dimensional size than their respective partner hole 215 or 235, although the shape of the hole is similar. The holes comprising each of the hole sets are only located in the top wall of the upper member since this keeps all holes under continuous compression during loading, and minimizes the possibility of cracks to propagate.

The present invention also identified non-critical stress areas on the lower tension member 40 as additional areas for reducing mass. The cross sectional thickness of bottom wall 49 was reduced from 0.75 inches to 0.6125 inches, and this thickness was maintained along the entire length of lower member 40. The amount of cross sectional reduction might be different for other sideframe designs, but the relative variations would be roughly the same when applied to different capacity sideframes of the type applicable to this invention. The spring seat plate 16 attached to lower member 40 was reduced in cross sectional thickness from 0.8125 inches to 0.75 inches and additional weight savings was gained when the pair of spaced lightener holes 245,255 was added to the center of plate 16. The holes are laterally displaced from each other and the holes may be varied in size, shape and number, depending upon the specific sideframe design. The holes allow the midsection area to be cast from a single core, ensuring consistent wall cross sectional thicknesses, while decreasing the occurrences of walls being cast too thin, as happens when using past molding practices.

Regarding the diagonal tension members 46 and 48, close scrutiny of the lightener openings 120 and 130 shown on prior art sideframe of FIGS. 7–10, revealed them to be the cause of high stresses. Casting the area solid in the present invention eliminated the high stress condition and the need for special attention to finishing of the former hole edge.

It was also found that filling in the holes in the bottom wall increased the overall the strength of the tension member. This increase was so significant that reinforcing ribs 76,77, which extended beyond the apex of each respective triangular opening 60,70 were removed because they were no longer needed to resist twisting. In addition, the increased strength of the lower tension member allowed removal of additional mass from top wall 47 in the form of a lightener hole, and that mass was roughly equivalent to the mass added through the filling of former openings 120,130. However, instead of providing one large hole in top wall 47, and creating a source of weakness, FIGS. 2 and 2C illustrate that the mass being removed was to be split between a respective pair of lightener holes 265,275 and 285,295. Although FIG. 2C only shows holes 265,275, it should be understood that holes 285,295 on diagonal arm 48 are exactly the same in size and location. Each pair of holes is disposed in a spaced relationship along a respective web lightener hole 60,70. As best seen from the FIG. 2 illustration, each respective lightener hole 60,70 has a generally triangular shape as well as respective leg 71,72, which defines one side of the respective triangular openings. This leg also corresponds to a portion of the top wall 47 of the lower tension member 40. As FIG. 2C illustrates, each respective hole 265,285 is generally centered along its respective leg 71,72 and substantially extends across the width of top wall 47. The other respective holes 275,295 are equal in size and shape to each other and to holes 265,285 and they are an equal distance from its respective partner hole 265 or 285. Holes 275,295 are adjacent to a respective lower comer of the triangularly shaped holes 60 or 70, and extend downwardly along each respective diagonal arm 46 or 48, terminating before reaching either bend point 43 or 45.

FIG. 2B is a cross-sectional view taken along line B—B of FIG. 2 and it shows that additional lightener holes have also been added to each of the vertical column wear plate areas 57,58, in the form of an identical pair of twin lightener hole sets 230 and 240. As seen from the illustration, column 55 contains the rectangularly configured twin holes 240A and 240B. Likewise, column 53 will contain an identical set of twin holes 230A and 230B, even though they are not specifically shown in the illustrations. Each of the twin hole sets on each column are in an opposed, confronting relationship to each other, and each set is disposed between a respective wear plate attachment bore 65 and 67 on each respective column. For the sake of this discussion, only the details of twin holes 240A and 240B will be provided, although the description equally applies to hole set 230.

As FIG. 2B illustrates, holes 240A and 240B are in a laterally spaced relationship from each other, wherein the vertical extent of each hole is about three times greater than the longitudinal extent, with the distance between each hole being designated as "X". Each hole 240A and 240B is also a laterally spaced distance from a respective column edge 55A or 55B; these distances are respectively designated as "Y" and "Z". Collectively, the distances "X", "Y", and "Z", approximately equals the width or lateral extent of an individual hole 240A or 240B. Therefore, it necessarily follows that the combined width or lateral extent of both holes 240A and 240B, is about two-thirds of the total width or lateral extent of the sideframe column 55. As mentioned, the other hole set 230 will have similar attributes to hole set 240. In field operation, each of the twin hole sets will be covered by a wear plate (not shown) which is attached to each vertical column by bolting it into bores 65 and 67.

When considering all of the additionally added sideframe holes and the reduced cross sections of the top and bottom walls of the lower tension member and of the spring plate 16, a total sideframe weight savings of approximately between four and ten percent can be realized over a prior art sideframe like that of FIGS. 7–10. The range of weight savings is attributable to the particular type of truck being employed. For example, if a pro-rated 100 ton truck were considered, the final weight savings would amount to about 4% of the original base weight of a 100 ton capacity side frame, or the two trucks would be reduced in weight by about 160 pounds per car. Collectively, significant weight savings are realized when all the cars in a train unit are considered.

Figure 5:
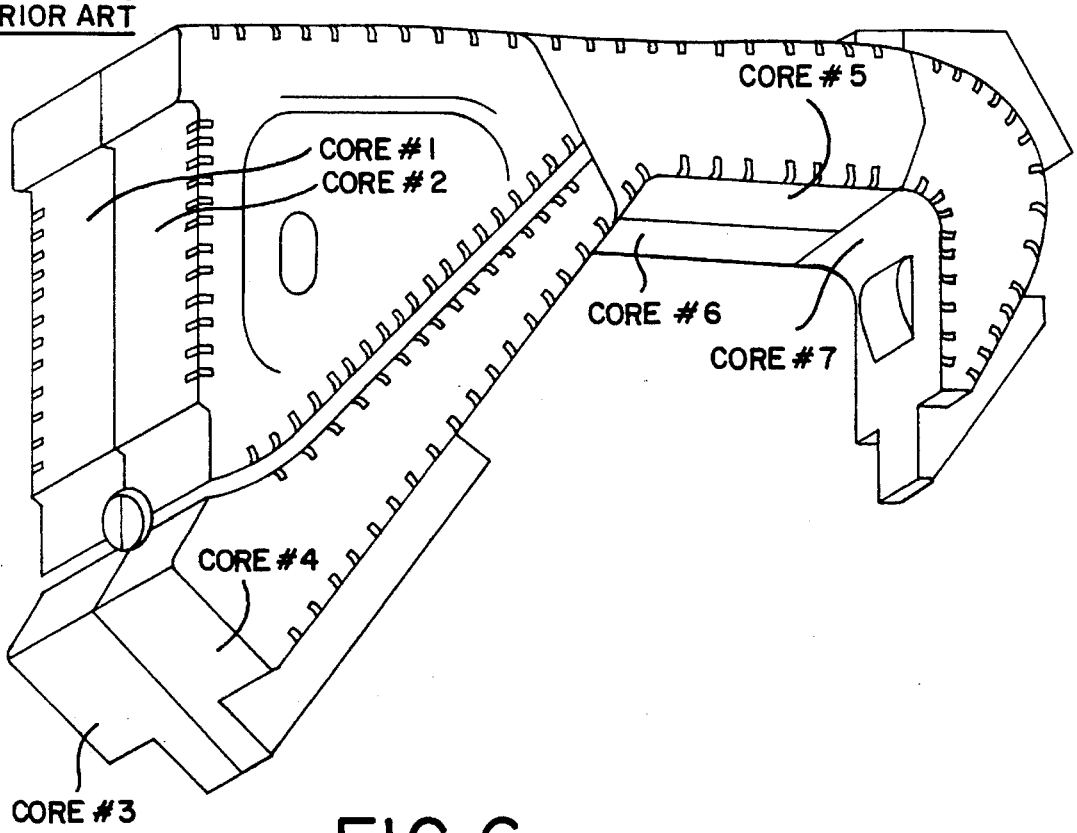
FIG. 5 PRIOR ART
FIG. 5 is a perspective view of one end of a prior art sideframe showing the multiplicity of cores required to produce that sideframe end.
Figure 6:
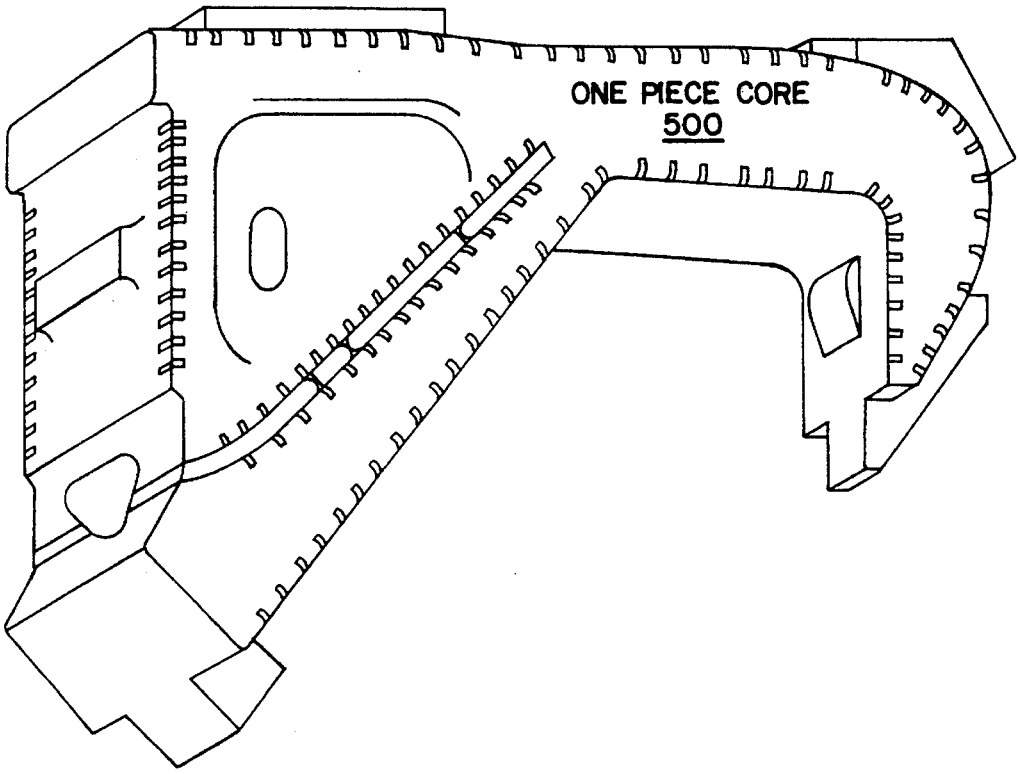
FIG. 6 is a perspective view of the single core required to produce one end of the sideframe of the present invention.

The foregoing structural changes have also gone hand-in-hand in making very dramatic changes upon the core making practices in relation to casting the sideframe. For instance, FIG. 5 shows a typical prior art core arrangement when casting one end of a sideframe. In this figure, it is seen that seven cores are required to form each sideframe end, or fourteen cores total per mold, just to make the sideframe ends; the core required to make the midsection will be discussed shortly. However, when casting a sideframe of the present invention, one can see from FIG. 6 that each end of the sideframe can be cast with a single core 500,600 (core 600 is not shown but represents the single core for the other end). Thus, the total requirement of 14 cores in this part of the sideframe can be reduced to only two cores. This substantial reduction in cores is accomplishable due to the fact that several of the added lightener holes, namely holes 185,205, 215, 265,275, and 230 seen in FIGS. 1 and 2 have actually improved the coring arrangement on each sideframe end because the casting mold can now be partially supported through these lightener holes instead of by chaplets, as will be explained below.

Figure 4A:
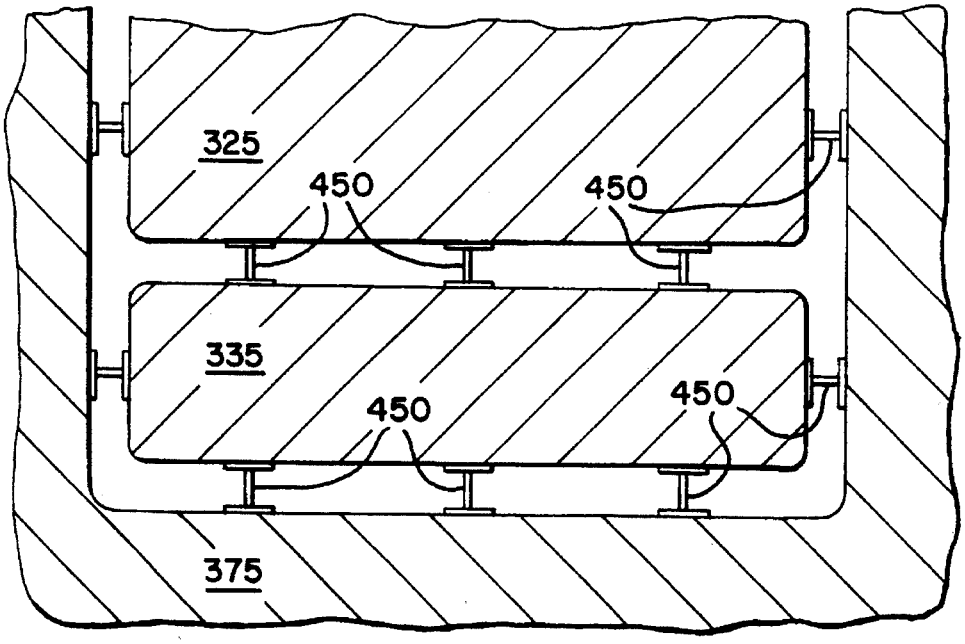
FIG. 4A PRIOR ART
FIG. 4A is a cross-sectional view representing the positioning arrangement of the cores within a casting mold of a prior art sideframe.
Figure 4B:
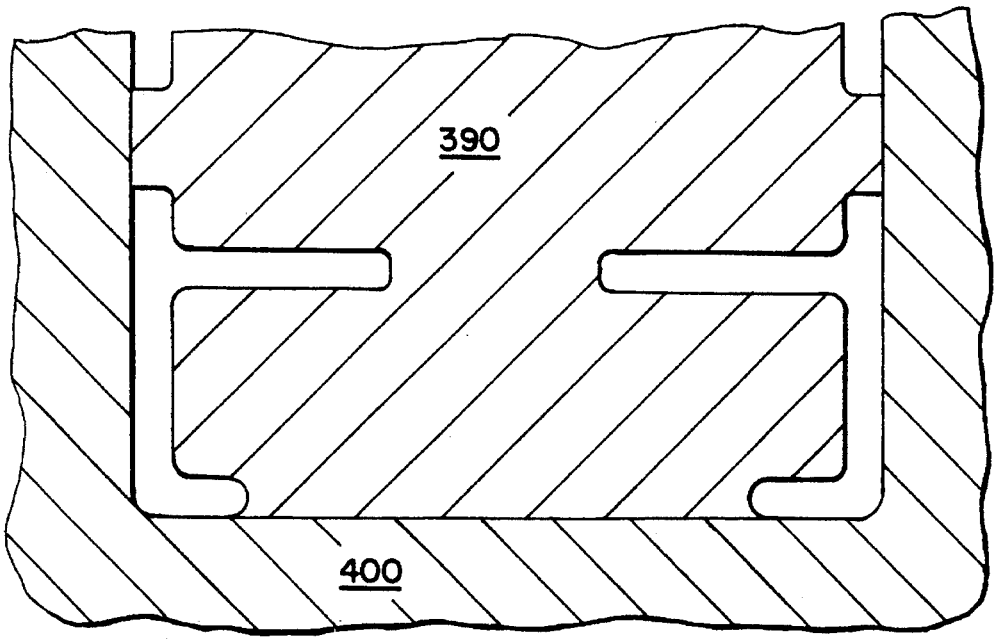
FIG. 4B is a cross-sectional view representing the positioning arrangement of a single core arrangement within a casting mold of the present invention.
Figure 11A:
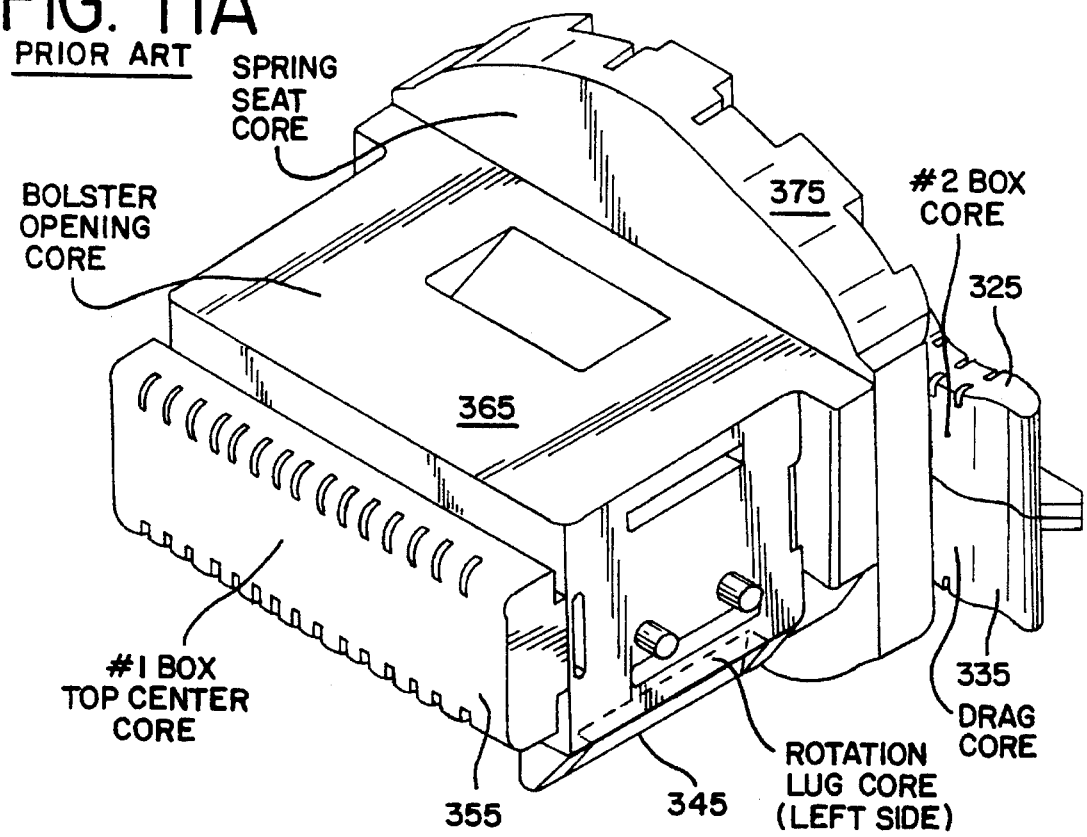
FIG. 11A PRIOR ART
FIG. 11A is a perspective view of a prior art bolster midsection showing the multiplicity of cores required to produce this section of the sideframe.
Figure 11B:
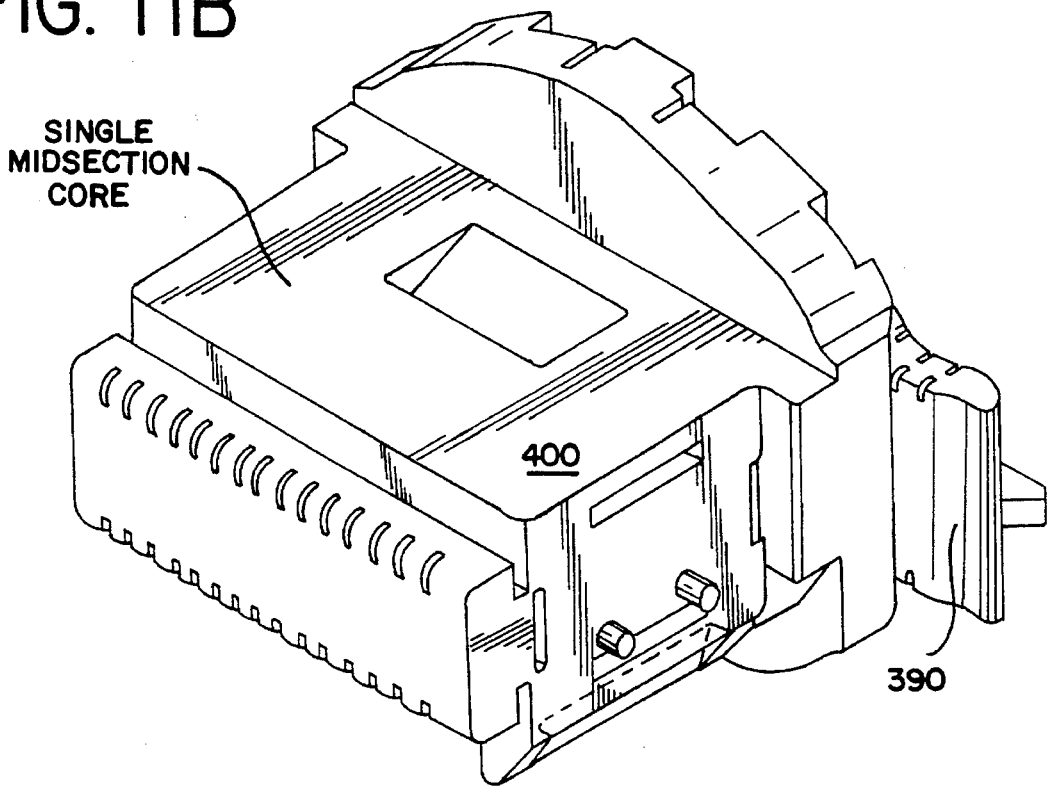
FIG. 11B is a perspective view of the single core required to produce the midsection of the present invention.

In addition to reducing the number of cores in the end section of the sideframe, further core consolidation is accomplished in the midsection area of the sideframe too. This is best understood by comparing FIGS. 11A and 11B, and it should be understood that this comparison generally applies to the sideframe end core reductions also. FIG. 1 1B illustrates that the midsection can be reduced from a total of cores (See FIG. 11A) to only one core. Part of this consolidation is made possible by the inclusion of holes 245 and 255 which are shown in FIGS. 2B and 3. These holes allow the attachment of the bottom center cores 325,335 (#2 BOX COPE and DRAG of FIG. 11) to the spring seat core 365. The attachment means is illustrated and best understood by viewing FIGS. 4A and 4B. FIG. 4A shows how prior molds required separate cores for the spring seat plate 325 and the far bottom center of the sideframe 325,335. It is also seen that the prior system required numerous chaplets 450 to hold the various cores apart from each other. FIG. 4B shows that with the sideframe of the present invention, the additional lightener holes 245,255 in the spring seat plate eliminate the need for the chaplets 450. This is only possible since the cores 325, 335 and 375 are tied together as a single core section 390, which is now part of the single midsection core 400. From a quality control aspect, removal of the chaplets by having only a single core for the sideframe midsection, virtually eliminates the problem of core shifting during mold handling. Although some chaplets are still used between each sideframe end section core and the midsection core, the core shifting problem is virtually eliminated throughout the sideframe mold, thereby virtually eliminating the possibility of a finished sideframe being thicker in cross section on one end compared to the other. As shown, the six midsection area currently uses seven cores, and the lightener holes help reduce the number to just one, large core 400. Thus, the total core consolidation in both sideframe ends and in the midsection of a sideframe of the present invention is reduced from 21 cores to only three cores, 400,500 and 600.

It should be understood that several additional cores are required for adding various appendages to the sideframe although those other cores will not be addressed by this invention; they represent an additional six cores in the manufacturing process. Thus, even with the six additional cores, the present invention significantly reduces the total number of cores in a complete sideframe from 27, to a new total of only nine. The large, single cores used for the sideframe ends and midsection, provide several substantial advantages over a similar casting made from the traditional number of cores. As mentioned earlier, the greatest advantage is related to multiple coring sometimes having a tendency to shift during the handling of the mold. The result is that internal metallic mismatches can be caused in the final casting, and sometimes they are extreme enough to require the casting to be scrapped. Secondly, the single core eliminates the multitude of seam lines which normally result between the faces of multiple cores. Elimination of these seam lines improves the appearance of the final casting, and it reduces the amount of preparatory or finishing work necessary to remove the unsightly lines. Moreover, the elimination of seam lines improves the internal casting quality of the workpiece by either eliminating or greatly reducing the potential for stress risers which tend to form along the entire seam line. Furthermore, a casting made from only nine cores, instead of 27, is considerably cheaper to produce due to substantially lower manpower requirements, equipment costs, and material costs. Those in the casting field know that the tooling costs in creating a single mold, as well as the replacement maintenance necessary for retaining quality standards for each mold is substantial. In addition, far less waste of mold-sand occurs when only one mold has to be formed, and less waste also reduces other interrelated costs such as clean-up labor. Finally, the relative motion between cores in a multiple core casting can actually dislodge some of the sand particles in the core, with these particles ultimately becoming inclusions in the finally-cast metal. As mentioned earlier, inclusions can either potentially become stress concentration areas or simply result in an area on the casting which requires surface clean-up.

The foregoing details have been provided to describe the best motive invention and further variations in modifications may be made without departing from the spirit and scope of the invention which is defined in the following claims.

What is claimed is:

1. An improved railcar truck sideframe of relatively light weight construction having a longitudinal axis and a longitudinal sideframe midpoint, said sideframe including a longitudinally extending upper compression member having a front end with a downwardly projecting front pedestal jaw depending therefrom and a back end with a downwardly projecting rear pedestal jaw depending therefrom, a longitudinally extending lower tension member having a central portion disposed generally parallel to said upper compression member and having a first end and a second end, said first end interconnected to an upwardly extending first diagonal arm and defining a first bend point, said second end connected to an upwardly extending second diagonal arm and defining a second bend point, each of said diagonal arms extending upwards to and connecting with a respective upper compression member end at a respective said pedestal jaw, a first and a second vertical column member respectively disposed fore and aft of said sideframe midpoint and connecting said upper and lower members together, thereby defining a bolster opening and a midsection of said sideframe, each of said vertical columns having a base and a wear plate area, said wear plate area above said base, said compression member, said tension member, and each of said vertical column members comprised of a respective top wall, a respective bottom wall, and a pair of respective arcuate sidewalls interconnecting said top and bottom walls together to form a respective compression member core, a tension member core, and a pair of vertical column member cores, said lower tension member top wall further including a horizontally disposed spring seat plate, said plate substantially square in configuration and extending longitudinally between said vertical column members, said upper compression member, said first vertical column member, and said first diagonal arm on said lower tension member defining a from periphery, which said from periphery includes a front lightener opening substantially therebetween, and said upper compression member, said second vertical column member, and said second diagonal arm on said lower tension member defining a rear periphery, which said rear periphery includes a rear lightener opening substantially therebetween, the improvement comprising:

said upper compression member top wall having a pair of longitudinally spaced lightener hole sets formed therein, each of said hole sets generally disposed between a respective said vertical column member and a respective said pedestal jaw, each said hole set extending through said upper compression member top wall and in communication with said upper compression member core, each said hole set comprised of a first lightener hole and a second lightener hole, each said first and second lightener hole laterally centered on said upper compression member top wall, said first lightener holes of each said hole set substantially equal in cross-sectional area and proximate to a respective vertical column member, said second lightener holes of each said hole set substantially equal in cross-sectional area, said first lightener hole cross-sectional area being about twice the cross-sectional area of said second hole, said upper compression member further including an enlarged pedestal jaw hole at each said sideframe end in close proximity to a respective first lightener hole of said hole set, each said pedestal jaw hole extending through said upper compression member top wall and communicating with said upper compression member core, each respective said enlarged jaw hole extending around a respective said respective pedestal jaw and laterally centered on said upper compression member top wall;

said lower tension member having a substantially solid bottom wall and a top wall with a respective pair of lightener holes in each respective said diagonal arm, each respective said pair of tension member lightener holes comprised of a first lightener hole and a second lightener hole, all said tension member lightener holes substantially equal in cross-sectional area, said first lightener hole on said front diagonal arm generally centered below said front lightener opening, and said second lightener hole on said front diagonal arm generally centered between said first lightener hole and said first bend point, said first lightener hole on said rear diagonal arm generally centered below said rear lightener opening, and said second lightener hole on said rear diagonal arm generally centered between said second lightener hole and said second bend point, each said pair of tension member lightener holes extending through said lower tension member top wall and in communication with said lower tension member core;

said spring seat plate having a pair of spaced lightener openings formed in a top face of said plate such that said spring plate lightener openings are generally centered on said plate and laterally spaced from each other, said spring plate lightener openings extending through said plate and in communication with said lower tension member core;

each of said vertical column member, including a respective set of twin lightener openings generally located in said vertical wear plate area of said column, each said set of twin lightener openings in opposed confronting relationship to each other, each said set of twin lightener openings having substantially similar rectangular shapes defined by a vertical extent and a horizontal extent, said vertical extent of said rectangular shape being greater than said horizontal extent, said twin lightener openings on each said vertical column member extending through said respective column member top wall and in communication with a respective vertical column member core.

2. The sideframe of claim 1 wherein said twin lightener openings in each said vertical column and said spaced pair of lightener openings in said spring seat plate allow said sideframe midsection to be configured as a single casting core.

3. The sideframe of claim 2 wherein said substantially solid bottom wall of said lower tension member first diagonal arm, said lightener hole set of said upper compression member front end, and said enlarged hole of said front pedestal jaw allows said sideframe front end to be configured as a single casting core.

4. The sideframe of claim 3 wherein said substantially solid bottom wall of said lower tension member second diagonal arm, said lightener hole set of said upper compression member back end, and said enlarged hole of said back pedestal jaw allowing said sideframe back end to be configured as a single casting core.

5. The sideframe of claim 4 wherein each of said sideframe front and back end cores and said sideframe midsection core are containable within a casting mold when said casting mold is used for forming said sideframe through casting.

6. The sideframe of claim 5 wherein said midsection core and said front and back cores are supportable by said casting mold.

7. The sideframe of claim 1 wherein said bottom wall of said lower tension member is defined by a cross sectional thickness, said thickness being substantially constant between said sideframe front and back ends.

* * * * *